US006446411B2

(12) United States Patent
Natelli, Jr.

(10) Patent No.: US 6,446,411 B2
(45) **Date of Patent: *Sep. 10, 2002**

(54) REINFORCED POLE WITH APPARATUS AND METHOD FOR ANCHORING

(76) Inventor: Anthony Mario Natelli, Jr., 20301 Martinsburg Rd., Dickerson, MD (US) 20842

( * ) Notice: Subject to any disclaimer, the term of this patent is extended or adjusted under 35 U.S.C. 154(b) by 0 days.

This patent is subject to a terminal disclaimer.

(21) Appl. No.: 09/681,886

(22) Filed: Jun. 20, 2001

Related U.S. Application Data

(63) Continuation-in-part of application No. 09/404,579, filed on Sep. 24, 1999, now Pat. No. 6,282,861, and a continuation-in-part of application No. 09/317,830, filed on May 25, 1999, now Pat. No. 6,202,371, and a continuation-in-part of application No. 09/810,402, filed on Mar. 19, 2001, now abandoned.

(51) Int. Cl.[7] ..... E04C 3/36

(52) U.S. Cl. ..... 52/730.1; 52/730.4; 52/736.1; 52/736.3; 52/720.3; 52/170

(58) Field of Search ..... 52/170, 166, 295, 52/296, 297, 720.3, 730.1, 730.4, 736.1, 736.3

(56) References Cited

U.S. PATENT DOCUMENTS

| | | | | |
|---|---|---|---|---|
| 265,106 | A | | 9/1882 | Lee |
| 1,842,547 | A | | 1/1932 | Hammel |
| 2,099,126 | A | | 11/1937 | Larsen |
| 3,349,531 | A | | 10/1967 | Watson |
| 3,621,663 | A | | 11/1971 | Otani |
| 3,792,680 | A | | 2/1974 | Allen |
| 3,972,529 | A | | 8/1976 | McNeil |
| 4,642,964 | A | * | 2/1987 | Kellison ..... 2/198.7 |
| 4,798,273 | A | | 1/1989 | Ward, II |
| 4,986,406 | A | | 1/1991 | Winsor |
| 5,339,594 | A | | 8/1994 | Ventura-Berti |
| 5,562,377 | A | * | 10/1996 | Giannuzzi et al. ..... 411/82 |
| 5,572,846 | A | | 11/1996 | Sosa |
| 5,666,774 | A | | 9/1997 | Cummins |
| D396,655 | S | | 8/1998 | Anderson |
| 5,803,228 | A | | 9/1998 | Lucas |
| 5,806,262 | A | | 9/1998 | Nagle |
| 5,826,387 | A | | 10/1998 | Henderson et al. |
| 5,869,159 | A | | 2/1999 | Padilla |
| 5,878,540 | A | | 3/1999 | Morstein |
| 6,098,361 | A | | 8/2000 | Roten et al. |

FOREIGN PATENT DOCUMENTS

| | | |
|---|---|---|
| CA | 885158 | 11/1971 |
| FR | 2 624 903 | 6/1989 |

* cited by examiner

*Primary Examiner*—Carl D. Friedman
*Assistant Examiner*—Jennifer I. Thissell
(74) *Attorney, Agent, or Firm*—Stephen Christopher Swift; Swift Law Office

(57) ABSTRACT

A pole that is reinforced by a hardening compound applied to its surface, preferably in vertical strips, and an apparatus and method of anchoring the pole or another upright object. In a first preferred embodiment, the pole is welded to a base plate, with hollow metal cylinders welded to an opposite surface of the plate. In a second preferred embodiment, the base plate is polygonal, with studs extending from vertices. The studs are bent downward at right angles from the plate. In a third preferred embodiment, a sleeve is retained on the base plate, and the pole or a channel is retained in the sleeve. In the fourth preferred embodiment, studs extend downward from the bottom of the pole or channel. In all the preferred embodiments, holes are formed in a concrete surface, adhesive is inserted into the holes, and the metal cylinders or studs are inserted into the holes.

9 Claims, 17 Drawing Sheets

REINFORCED POLE WITH APPARATUS AND METHOD FOR ANCHORING

CROSS REFERENCE TO RELATED APPLICATIONS

This application is a Continuation-In-Part of patent application Ser. No. 09/317,830, filed on May 25, 1999, and issued as U.S. Pat. No. 6,202,371 on Mar. 20, 2001, patent application Ser. No. 09/404,579, filed on Sep. 24, 1999, now U.S. Pat. No. 6,282,861 patent application Ser. No. 09/810,402, filed on Mar. 19, 2001 now abandoned.

BACKGROUND OF THE INVENTION

1. Field of the Invention

The present invention relates to poles, such as for parking meters, that are reinforced to prevent theft, and an apparatus and method for anchoring the parking meter poles in concrete.

2. Description of the Prior Art

Theft of coins from parking meters has become a serious problem in many cities. Theives have gotten around previous anti-theft devices by sawing through the pole holding the meter, and taking the meter=s head, coins and all, with them. In some cities, there have been large numbers of "decapitated" parking meters.

U.S. Pat. No. 265,106, issued on Sep. 26, 1882, to Robert Bristow Lee, discloses a device for forming lattice pillars, in which wire is wrapped around a cylindrical object in a spiral pattern. The instant invention is distinguishable, in that the hard-facing is welded to the pole in vertical strips.

U.S. Pat. No. 1,842,547, issued on Jan. 26, 1932, to Victor F. Hammel, discloses a cylindrical structure, in which a post or pole is supported by helically arranged bars or rods. Again, the instant invention is distinguishable, in that the hard-facing is weld ed to the pole in vertical strips.

U.S. Pat. No. 2,099,126, issued on Nov. 16, 1937, to Gabriel Larsen, discloses a method of forming tubes from a first material, with grooves in the outer surface of the tubes filled by a second material. The instant invention is distinguishable, in that the use of hard facing is disclosed, and the strips of hard facing are applied directly to the outer surface, not in grooves.

U.S. Pat. No. 3,349,531, issued on Oct. 31, 1967, to George H. Watson, discloses a frangible connector assembly for stanchions, poles, and standards, which may b e used in parking meter poles, in which a n anchoring bolt is embedded in concrete. The instant invention is distinguishable, in that in it the anchoring tubes are attached to the concrete by epoxy.

U.S. Pat. No. 3,621,663, issued on Nov. 23, 1971, to Akemasa Otani, discloses a ribbed file. The ribs are distinguishable from the strips of hard facing of the instant invention, in that the ribs are formed in one piece, from the same material, at the same time as the file, while the hard facing is a harder material that is added later.

U.S. Pat. No. 3,792,680, issued on Feb. 17, 1974, to Francis R. Allen, discloses a flag pole, which does not have the strips of hard facing of the instant invention.

U.S. Pat. No. 3,972,529, issued on Aug. 3, 1976, to Walter F. McNeil, discloses reinforced tubular metallic materials, having recesses cut along their outer surfaces, into which graphite fiber strips are inserted. The instant invention is distinguishable, in that in it a hardening compound, rather than graphite fiber, is applied over the surface of the parking meter poles, rather than in recesses.

U.S. Pat. No. 4,798,273, issued on Jan. 16, 1989, to Seth Ward, II, discloses a parking meter anchor with expansion wedges that fit against the interior surface of a hollow post. The instant invention is distinguishable, in that in it the wedges are welded to the post.

U.S. Pat. No. 4,986,406, issued on Jan. 22, 1991, to B. Drew Winsor, discloses an anti-theft parking meter anchoring device, for anchoring a parking meter head to the top of a support post, by means of a locking pin that passes through transverse holes in the bottom of the parking meter head and the top of the support post. The instant invention is distinguishable, as it uses welding to secure the parking meter head on the support post, and does not require a locking pin.

U.S. Pat. No. 5,339,594, issued on Aug. 23, 1994, to Miguel Ventera-Berti, discloses a post designed to support electric power supply cables, having a hollow core of ceramic material surrounded by a reinforcement of iron rods embedded in a polymer and wrapped in a polymer envelop, but does not disclose the strips of hard facing of the instant invention.

U.S. Pat. No. 5,666,774, issued on Sep. 16, 1997, to Alfred D. Commins, discloses an adjustable support system for joining structural members, in which a threaded rod is secured in concrete by grout or epoxy. The instant invention is distinguishable, in that in it tubes or rods are welded to the base plate, need not be threaded, and in a preferred embodiment have hollow interiors to allow more effective bonding to the hardened epoxy.

U.S. Pat. No. 5,572,846, issued on Nov. 12, 1996, to Jesus M. Sosa, discloses a poster resistant utility pole, with protruding structures such as splines or ribs that decrease the surface area available for contact with adhesive posters and handbills, as compared to a smooth surface. It does not disclose use of hard facing to make the pole more difficult to cut through, as in the instant invention.

U.S. Pat. No. 5,803,228, issued on Sep. 8, 1998, to Tom Lucas, discloses parking meter assemblies designed to prevent theft of coins in the parking meters, by means of reinforced steel sheets around the coin receptacle. The instant invention is distinguishable, in that it reinforces the pole to which the head of the parking meter is attached, and strengthens the connection of the pole to the head by welding.

U.S. Pat. No. 5,806,262, issued on Sep. 1, 1998, to Gordon A. Nagle, discloses a post and a method of emplacing the post in concrete. The instant invention is distinguishable, in that it uses epoxy to bind the metal cylinders in the base plate to a concrete surface.

U.S. Pat. No. 5,826,387, issued on Oct. 27, 1998, to Allan P. Henderson and Miller B. Patrick, discloses a pier foundation under high unit compression, in which metal rods are embedded in concrete, but without the use of epoxy, as in the instant invention.

U.S. Pat. No. 5,869,159, issued on Feb. 9, 1999, to Carl Padilla , discloses a cushioned pole cover and method of applying the cover, but does not disclose the use of hard facing, as in the instant invention.

U.S. Pat. No. 5,878,540, issued on Mar. 9, 1999, to Jerome Neil Morstein, discloses a utility pole base pan with drain, involving the embedding of metal bolts in concrete, without the use of epoxy, as in the instant invention.

U.S. Pat. No. 6,098,361, issued on Aug. 8, 2000, to J. Michael Roten, William C. Kiehl and Seth Ward, II, discloses a parking meter anchor system, including an anchor receptacle mounted in the ground, but does not disclose the use of epoxy as in the instant invention.

U.S. Pat. No. Des. 396,655, issued on Aug. 4, 1998, to John Henry Anderson, discloses a design for a pedestal for a parking meter, but does not disclose the reinforcing and anchoring means of the instant invention.

Canadian Patent No. 885,158, issued on Nov. 9, 1971, to Joseph D. George, discloses a matter of installing poles in a concrete surface, in which grout is used rather than epoxy.

French Patent No. 2,624,903, published on Jun. 23, 1989, to Louis Daniel Champy and Christian Biaille, discloses a reinforced concrete base unit for a one-piece pylon, again involving the embedding of metal in concrete without the use of epoxy.

None of the above inventions and patents, taken either singly or in combination, will be seen to describe the instant invention as claimed.

SUMMARY OF THE INVENTION

The present invention is a pole, such as for a parking meter, that is reinforced by a hardening compound applied to its surface, preferably in vertical strips, and a method of anchoring the pole. The hardening compound is preferably a solder that is applied to the external surface of the pole by welding. Once it cools, this hardening compound cannot be cut with an ordinary hacksaw. For esthetic purposes, and to prevent rust to the pole, a PVC pipe with a slightly greater diameter than the pole is placed over and around the pole. In the first preferred embodiment, the pole is welded to a metal plate, with hollow metal cylinders welded to and extending from an opposite surface of the plate. Holes are drilled in a concrete surface, epoxy or other adhesive is inserted into the holes, and the metal cylinders are inserted into the holes before the epoxy or other adhesive hardens. This makes it possible for the pole to be securely attached to the concrete surface, without the need for digging several feet below the surface. Furthermore, in the first preferred embodiment, circular transverse holes are made in the top of the pole using a plasma cutter, and expander jaws are then welded to the interior of the pole, to securely attach the head of the parking meter to the pole.

The second preferred embodiment differs from the first preferred embodiment, in that the base plate is formed from a square or triangular base plate, from which portions are cut away along the sides, so that what remains is a square or triangular plate with studs extending from the corners. The studs are then heated and bent downward at right angles from the plate. The studs are then inserted into holes in the concrete surface, and retained by epoxy or other adhesive, in the same manner as the metal cylinders in the first preferred embodiment.

In the third preferred embodiment, a sleeve is retained on the base plate of the second preferred embodiment, and the pole or a U-shaped channel is retained in the sleeve. A sign or other object may be attached to the top of the pole or channel.

In the fourth preferred embodiment, portions are cut away from the bottom of a pole or channel, leaving studs that extend downward. The pole or channel is inserted through a hole in the middle of the base plate, and welded to the base plate. The studs are inserted into holes in the concrete surface and retained therein by epoxy or other adhesive.

Accordingly, it is a principal object of the invention to prevent parking meter theft.

It is another object of the invention to prevent theft of any object attached to a pole.

It is a further object of the invention to provide a convenient means for attaching parking meters to a concrete surface.

Still another object of the invention is to provide a means for securely attaching any upright object to a concrete surface.

Still a further object of the invention is to provide a means for more securely attaching the head of a parking meter to its supporting pole.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF DRAWINGS

Similar reference characters denote corresponding features consistently throughout the attached drawings.

DETAILED DESCRIPTION

The present invention is designed primarily to prevent theft from parking meters, though it may also have other applications.

Figure 1:
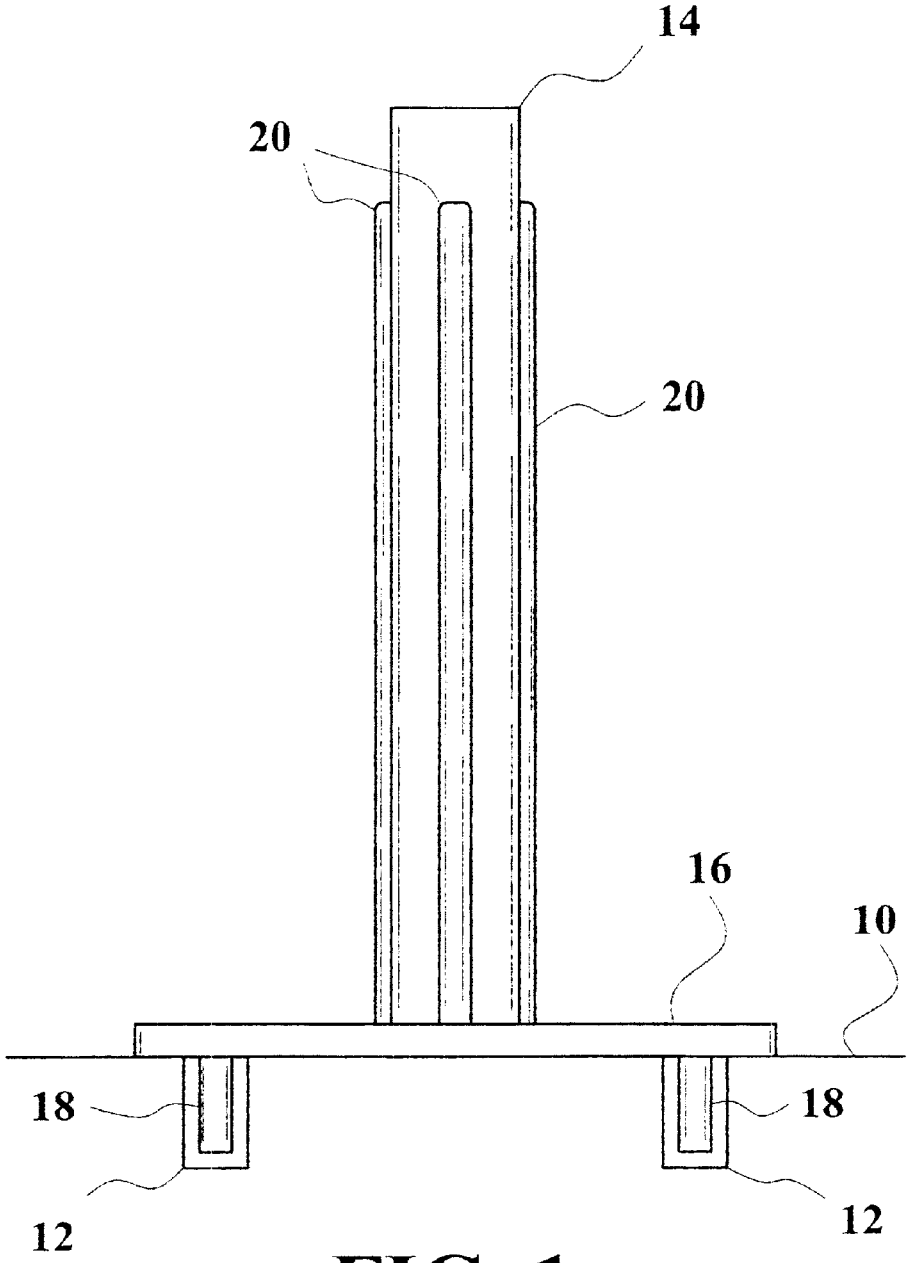
FIG. 1 is a front elevational view of the first preferred embodiment of the invention, before the PVC pipe and parking meter head are attached.

FIG. 1 is a front elevational view of the first preferred embodiment of the invention, before the polyvinyl chloride ("PVC") pipe and parking meter head are attached. The invention is retained on a concrete surface 10, into which holes 12 have been drilled. (Alternatively, the invention could be retained on another solid surface, such as rock or brick, or the holes could be formed by another method, such as the use of molds when the concrete is first poured.) A pipe 14 is welded to the top of a base plate 16. Tubes 18 are welded to the bottom of the base plate. Preferably, the pipe, base plate and tubes are all made of mild steel. (Alternatively, bolts or other anchoring members could be used in place of tubes, and other means of bonding or attachment could be substituted for welding.) A hard-facing compound is applied to the surface of the pipe, preferably in vertical strips by arc welding. The hard-facing compound is preferably an alloy containing carbon, chromium, molybdenum, manganese, silicon, boron and vanadium, having a Rockwell hardness number of at least 60. (Such hard-facing compounds are commercially available.) The strips of hard-facing should run from the bottom end of the pipe to almost the top of the pipe, but should end a short distance from the top to allow the parking meter head to be inserted over the pipe. The strips of hard-facing are difficult to cut through without the use of conspicuous special equipment that would attract the attention of authorities, thus preventing theft of coins in the parking meter by cutting through the pipe and taking the head to a private location where the coins can be removed.

Figure 2:
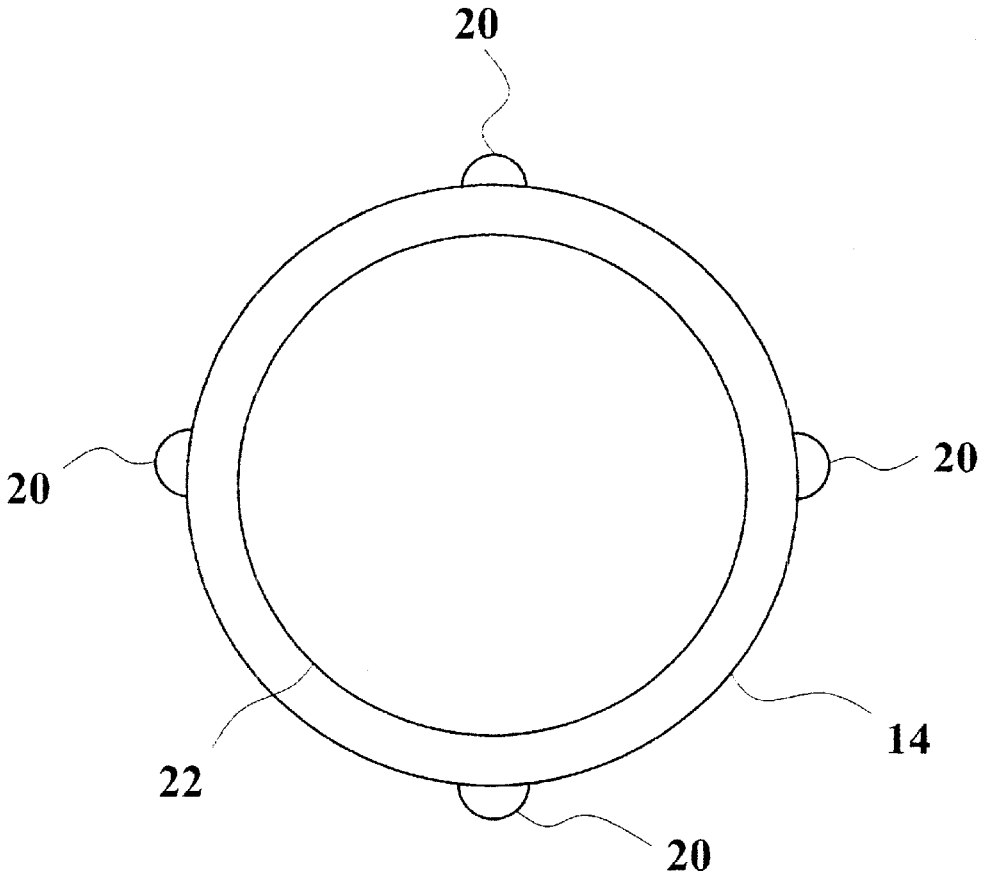
FIG. 2 is a top plan view of the steel pipe reinforced by the hard-facing.

FIG. 2 is a top plan view of the steel pipe 14 reinforced by the strips of hard-facing 20, showing the pipes hollow interior 22. Preferably, there should be at least four evenly spaced strips, to prevent a thief from being able to cut through a large angle of the pipe.

Figure 3:
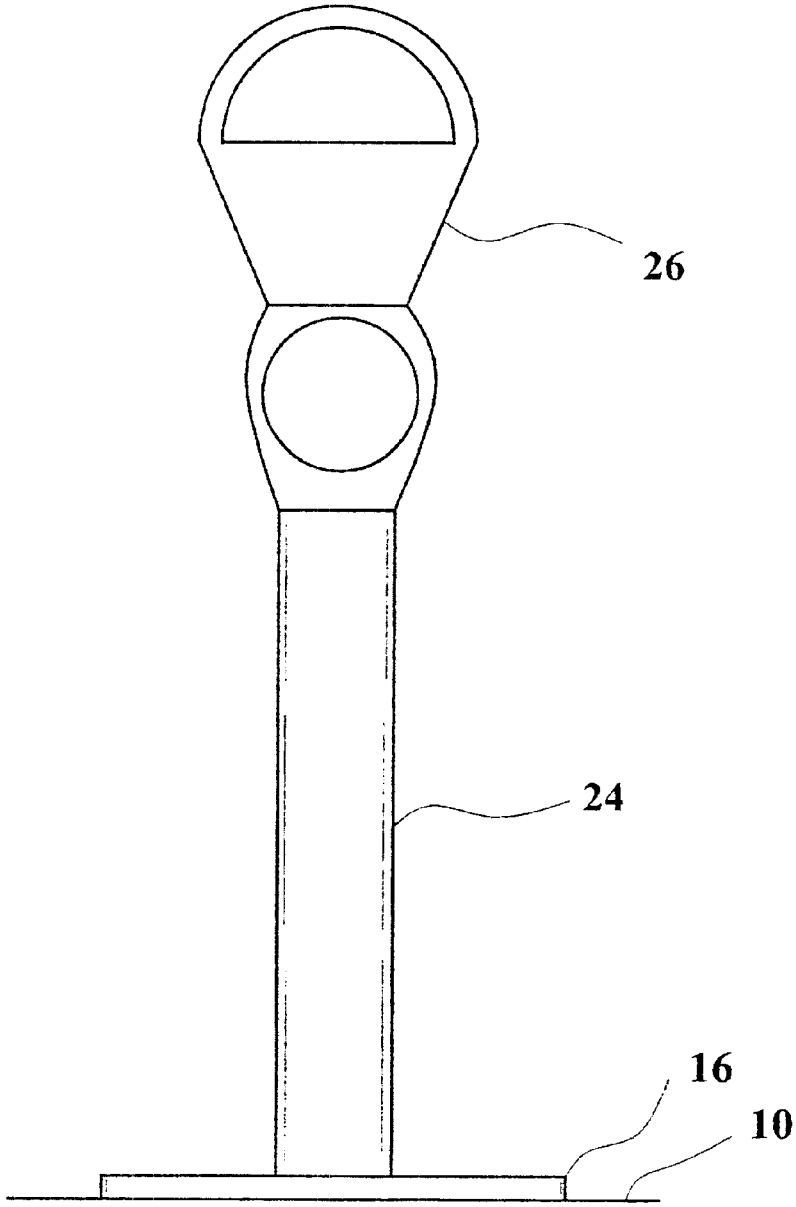
FIG. 3 is a front elevational view of the first preferred embodiment of the invention, after the PVC pipe and parking meter head have been attached.

FIG. 3 is a front elevation view of the first preferred embodiment of the invention, after the PVC pipe 24 and parking meter head 26 have been attached. Alternatively, two parking meter heads may be attached to the same pole (not shown in the drawings). The purpose of the PVC pipe is to improve the appearance of the parking meter, to prevent damage from chains used with bicycle locks, and to provide a maintenance-free surface. Alternatively, a pipe made of any other suitable waterproof substance could be used.

Figure 4:
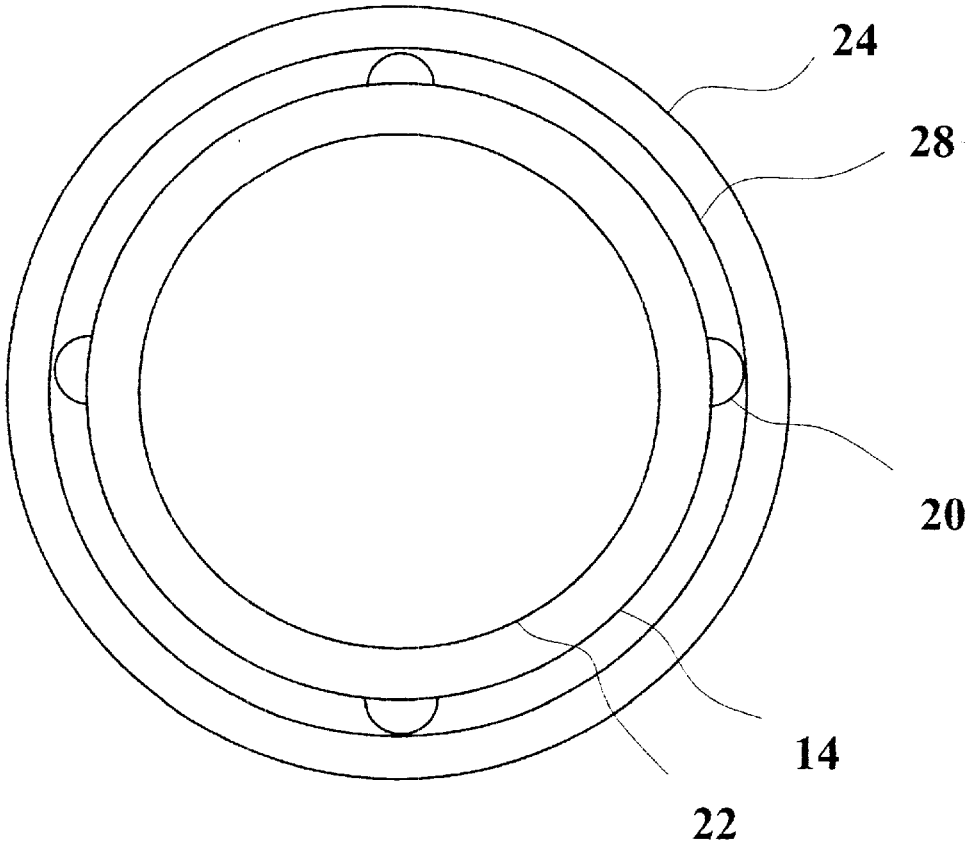
FIG. 4 is a top plan view of the reinforced steel pipe surrounded by the PVC pipe.

FIG. 4 is a top plan view, showing the metal pipe 14 with its hollow interior 22 and the strips of hard-facing 20, surrounded by the PVC pipe 24. Preferably, the interior surface of the PVC pipe should just touch the hard-facing, leaving a small gap 28 between the metal pipe and the PVC pipe. Optionally, one of the following three methods may be used to bond the interior surface of the PVC pipe to the hard-facing: (1) the metal pipe with the hard-facing is heated in an oven or by a blow torch, before placing the PVC pipe over it; (2) the PVC pipe is placed over the metal pipe before the hard-facing has cooled; or (3) a solvent is applied to the interior surface of the PVC pipe before it is placed over the metal pipe and the hard-facing.

Figure 5:
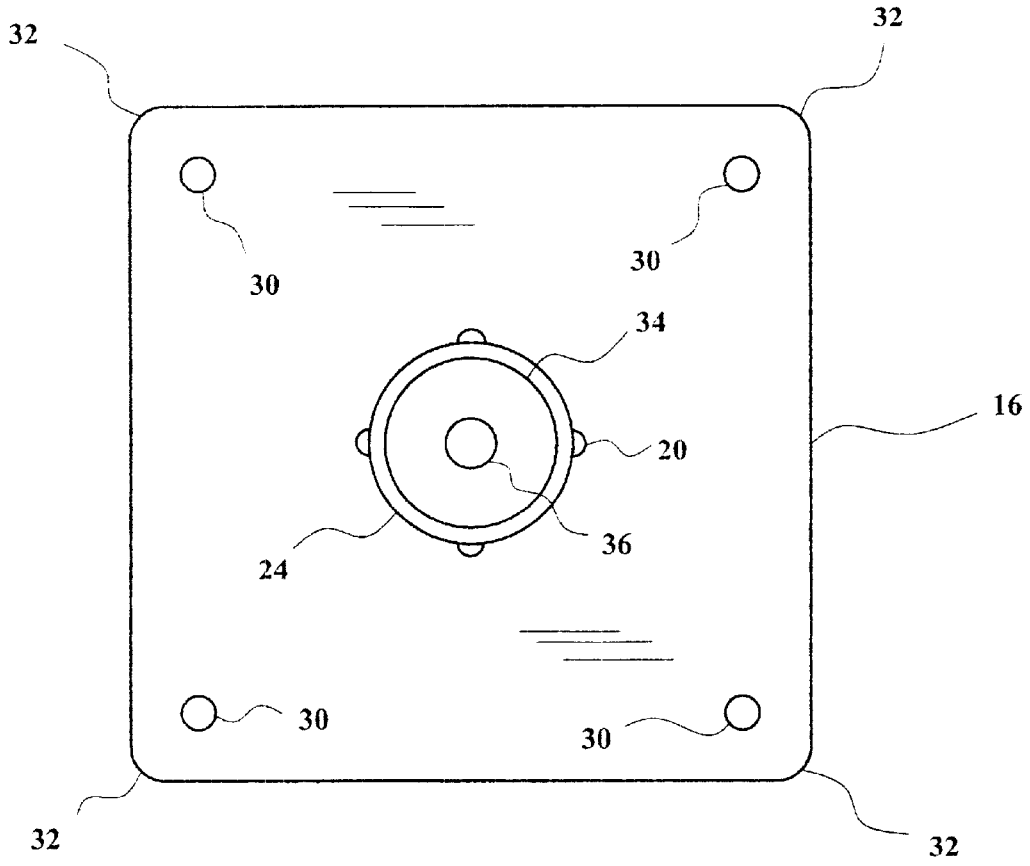
FIG. 5 is a top plan view of the first preferred embodiment of the invention, before the PVC pipe and parking meter head are attached.

FIG. 5 is a top plan view of the first preferred embodiment of the invention, before the PVC pipe and parking meter head are attached, showing four holes 30 that are drilled through the base plate 16 above the centers of the tubes welded to the other side of the plate. Also shown is a metal disk 34 that is welded inside the metal pipe near its top end. The disk has a threaded hole 36 through which a bolt (not shown in the drawings) is inserted to retain the parking meter head on the pole. Preferably, the corners 32 of the base plate should be rounded.

Figure 6:
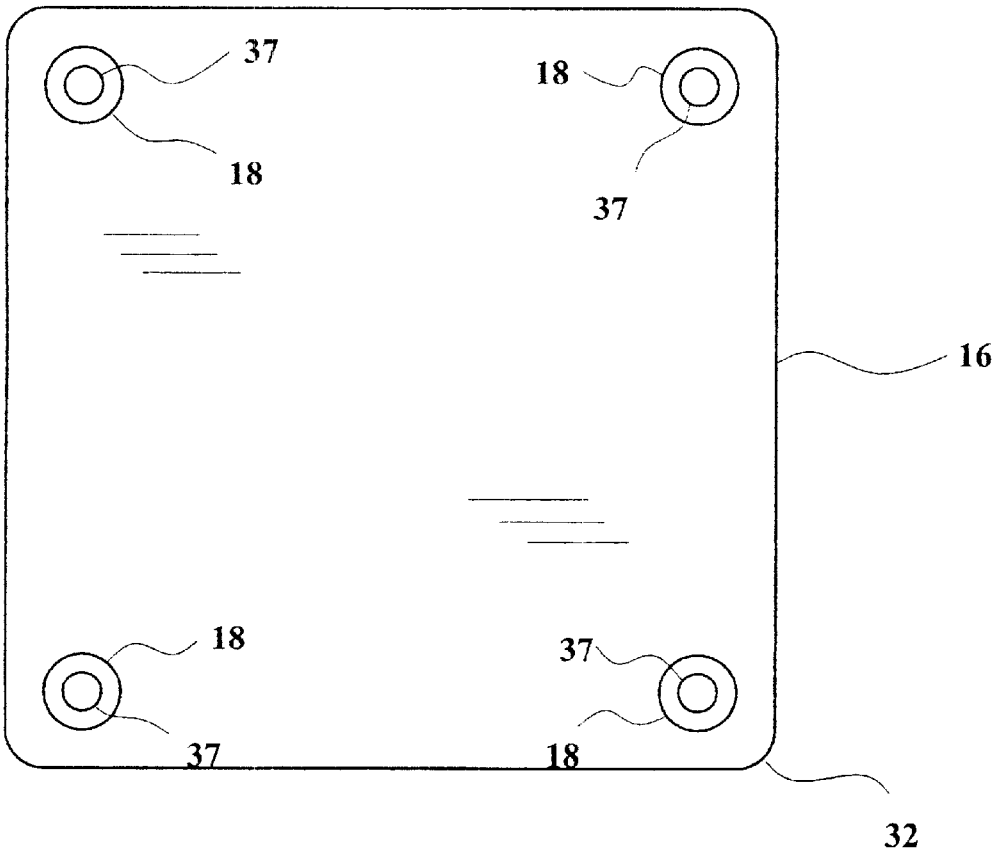
FIG. 6 is a bottom plan view of the first preferred embodiment of the invention.

FIG. 6 is a bottom plan view of the first preferred embodiment of the invention, showing the hollow interiors 37 of the tubes 18 welded to the base plate 16. Preferably, one tube should be adjacent to each corner of the base plate. Preferably, the base plate should be square, but rectangular, triangular, polygonal, circular and other shapes of base plates are within the scope of the invention.

Figure 7:
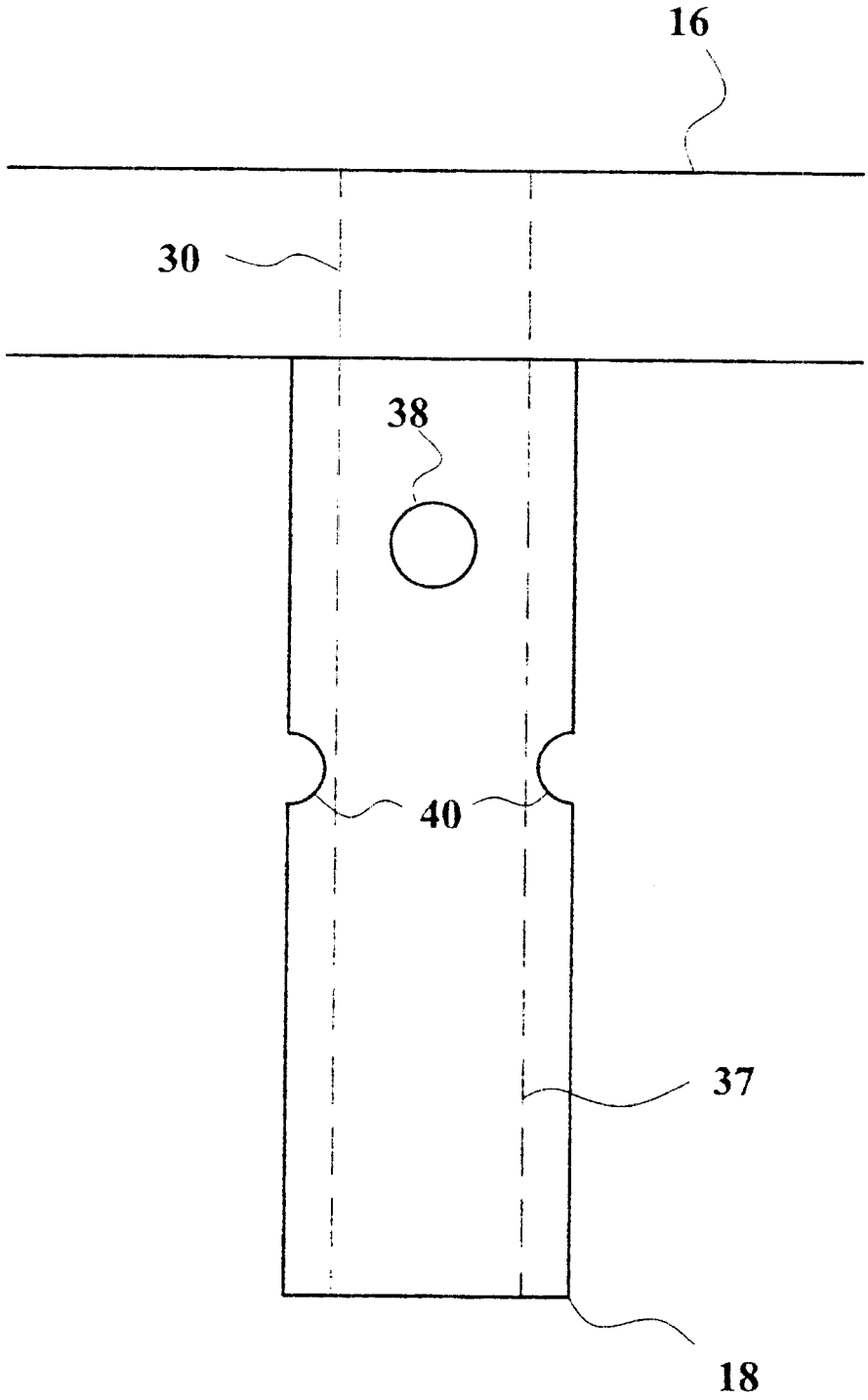
FIG. 7 is a detail view of one of the tubes attached to the base plate.
Figure 8:
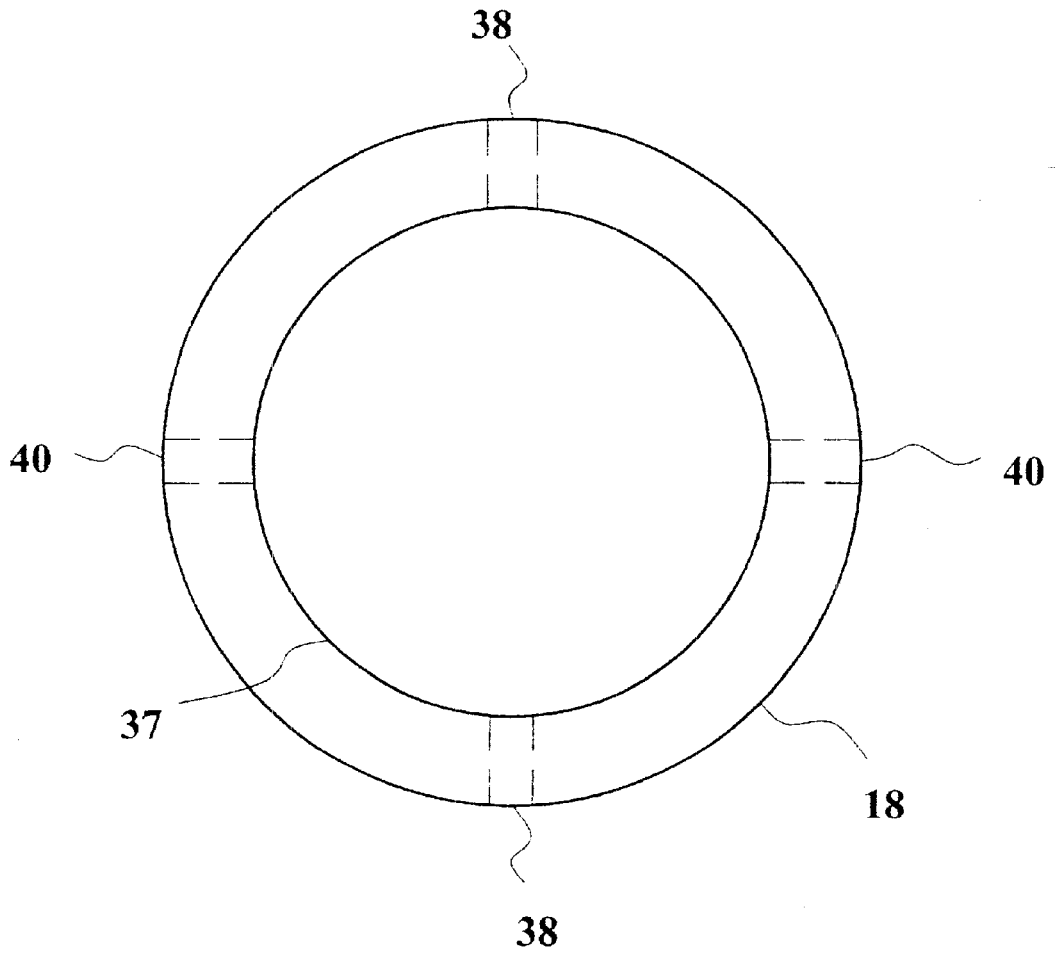
FIG. 8 is a bottom plan view of one of the tubes attached to the base plate.

FIG. 7 is a detail view of one of the tubes 18 attached to the base plate 18. The hollow interior 37 of the tube and the hole 30 through the base plate are indicated by broken lines. Also shown are transverse holes 38 and 40 drilled through the tube, at right angles to the axis of the tube and to each other. FIG. 8 is a bottom plan view of one of the tubes attached to the base plate, with the transverse holes 38 and 40 drilled through the tube at right angles indicated by broken lines.

When setting up the parking meter, the binder and catalyst of epoxy glue are mixed and then injected into the holes in the concrete (or other solid surface), and the tubes (or other anchoring elements) are then inserted into the holes. (Alternatively, any adhesive with sufficient bonding strength may be used in place of epoxy.) The hollow interiors and transverse holes of the tubes, and the holes in the base plate, serve to increase the surface area to which the epoxy can bind, thus increasing the strength of the bond between the metal and concrete. The holes in the base plate also allow air to escape from the tubes. The epoxy should be smoothed off at the tops of the holes in the base plate before it hardens, so that the epoxy filled holes will not be readily apparent. This method makes it possible to securely attach a parking meter (or other upright object, such as a stop sign or lamp post) to concrete, without having to drill several feet down (which could interfere with utility lines). Another advantage of this method is that parking meters have a low enough center of gravity that other means of support are not necessary while the epoxy hardens. With larger objects, such as lamp posts, external support may be necessary while the epoxy hardens. Optionally, the exterior and or interior surfaces of the tubes may be threaded for greater bonding strength.

Figure 9:
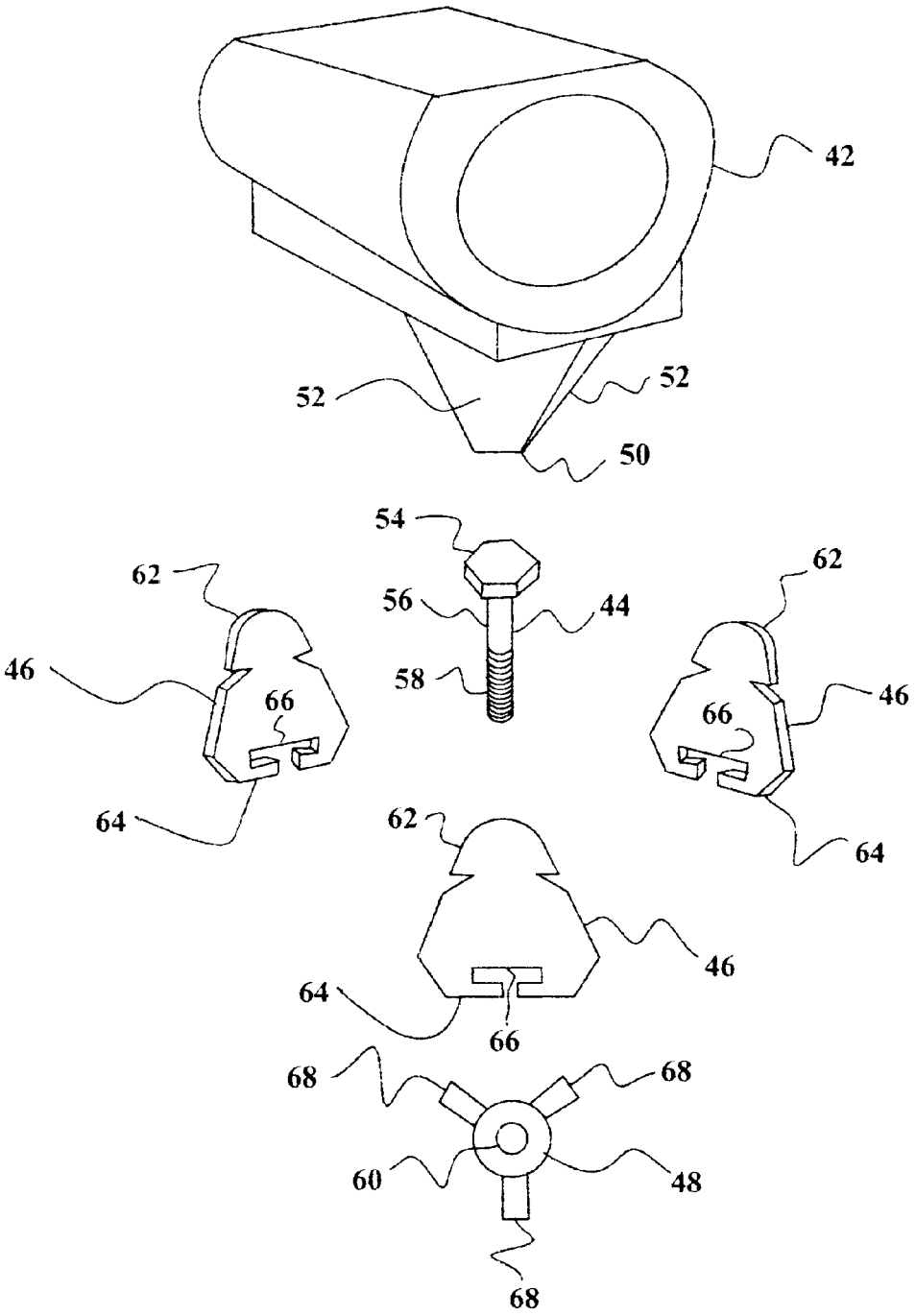
FIG. 9 is a perspective view of a lower housing of the parking meter head, a bolt, three expander jaws, and an expander nut, before they are assembled.
Figure 10:
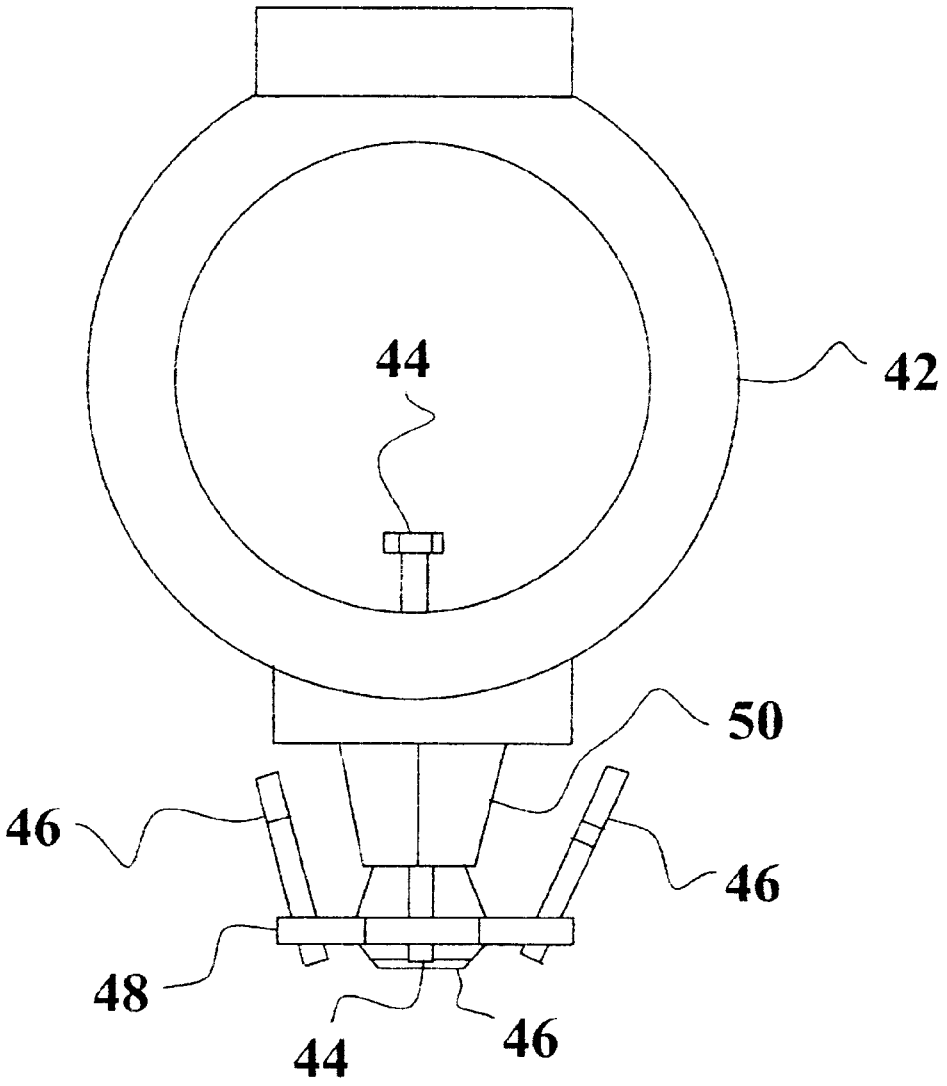
FIG. 10 is a front elevational view of the lower housing of the parking meter head, a bolt, three expander jaws, and an expander nut, after they have been assembled.
Figure 11:
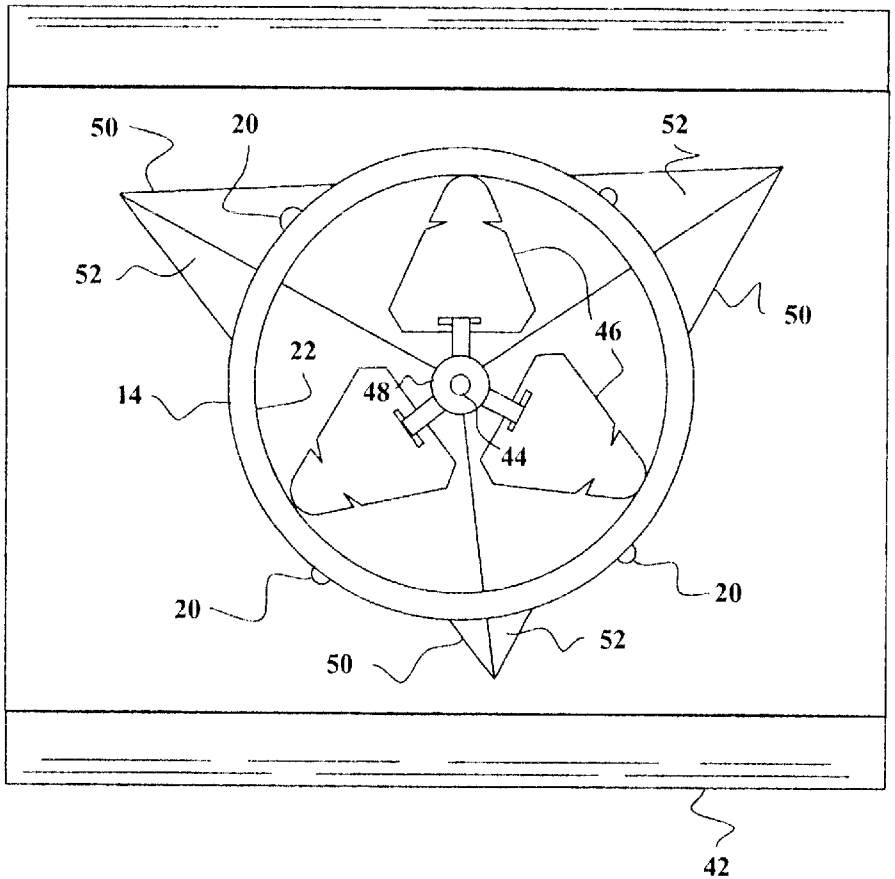
FIG. 11 is a bottom plan view, looking upwards from a horizontal cross-section of the pole, showing how the expander jaws are positioned when they have been fully expanded by turning the bolt.

In the preferred embodiment of the invention, the attachment of the head of the parking meter to the pole is reinforced by welding. FIG. 9 through 11 illustrate the way that parking meter heads are generally retained on their supporting poles in parking meters currently in use.

FIG. 9 is a perspective view of a lower housing 42 of the parking meter head, a bolt 44, three expander jaws 46, and an expander nut 48, before they are assembled. An upper housing and cap assembly (not shown in the drawings) are attached to the lower housing to complete the parking meter head. The lower housing has a bottom portion 50 with preferably three outward sloping surfaces 52 (only two of which are visible in FIG. 9). The bolt has a head 54 and a shaft 56 with male threading 58 that can engage female threading (not shown in the drawings) in the hole 60 in the expander nut. The expander jaws are preferably flat metal objects with narrow tops 62 and wide bottoms 64, with notches 66 in the bottoms. The expander nut has one projection 68 for each expander jaw. Parking meters currently on the market have three expander jaws; but this aspect of the invention can apply to parking meters (or other objects with similar connecting features) with any number of expander jaws. The number of outwardly sloping surfaces on the bottom portion of the lower housing should preferably be equal to the number of jaws.

FIG. 10 is a front elevational view of the lower housing, a bolt, three expander jaws, and an expander nut, after they have been assembled, but before the jaws have been expanded. The expander jaws are attached to the expander nut by fitting the projections of the expander nut into the notches of each of the expander jaws. The bolt is then inserted through a hole (not shown in the drawings) in the bottom center of the lower housing, brought in contact with the expander nut, and turned so that the male threads on the bolt engage the females threads in the hole of the expander nut, thus retaining the expander nut on the bolt. The lower housing, with the expander jaws which are retained on the expander nut which is retained by the bolt on the housing, is then placed over the top of the pole. Then the bolt is turned again to expand the jaws.

FIG. 11 is a bottom plan view, looking upwards from a horizontal cross-section of the steel pipe or other pole, showing how the expander jaws are positioned when they have been fully expanded by turning the bolt. As the bolt is turned, the expander nut and the jaws attached to it are pulled toward the bottom portion of the lower housing, thus bringing the jaws in contact with its outwardly sloping surfaces, so that the tops of the jaws are pushed outward until they contact the interior surface of the pole. The bolt is then tightened so that the jaws are firmly wedged between the interior surface 22 of the pole 14 and the outwardly sloping surfaces of the bottom portion of the lower housing. In parking meters currently in use, friction between the jaws and these surfaces is usually the only means by which the head is retained on the pole. Thus, it is easy for thieves to pry the head off the pole.

Figure 12:
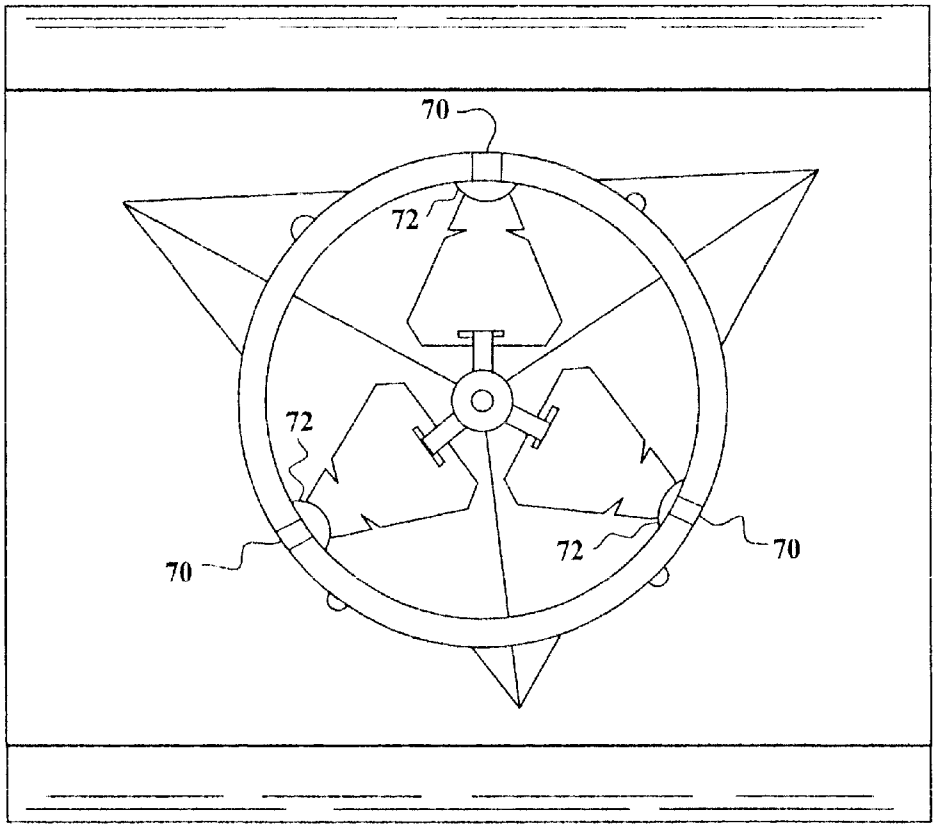
FIG. 12 is a bottom plan view, showing the holes made through the pole, and the welds between the top portions of the expander jaws and the interior of the pole.

FIG. 12 is a bottom plan view, showing the holes 70 made through the pole, and the welds 72 between the top portions of the expander jaws and the interior of the pole. Preferably, a plasma-arc cutter is used to make the holes. (Plasma-arc cutters and welders use gasses that are superheated until they are in a plasma state, where electrons are stripped off nuclei of atoms in the gasses, so that normally insulating gasses become conductors of electricity. Plasma-arc cutters can form holes in metal more quickly and accurately than conventional metal cutting torches. The same plasma-arc equipment may be used for both cutting and welding metal.) After a hole is made in the pipe near an expander jaw, a plasma-arc welder, or a MIG (Metal Inert Gas) welder or any other suitable welding equipment, may be used to weld the top of the jaw to the interior surface of the pipe. The jaw may also be welded to the bottom of the lower housing. Metal in a welding wire may be melted by the welder to complete the weld. The hole may be then be filled in with more metal from the welding wire or solder. Of course, once the PVC pipe is placed over the pole, the holes with not be visible anyway.

Figure 13:
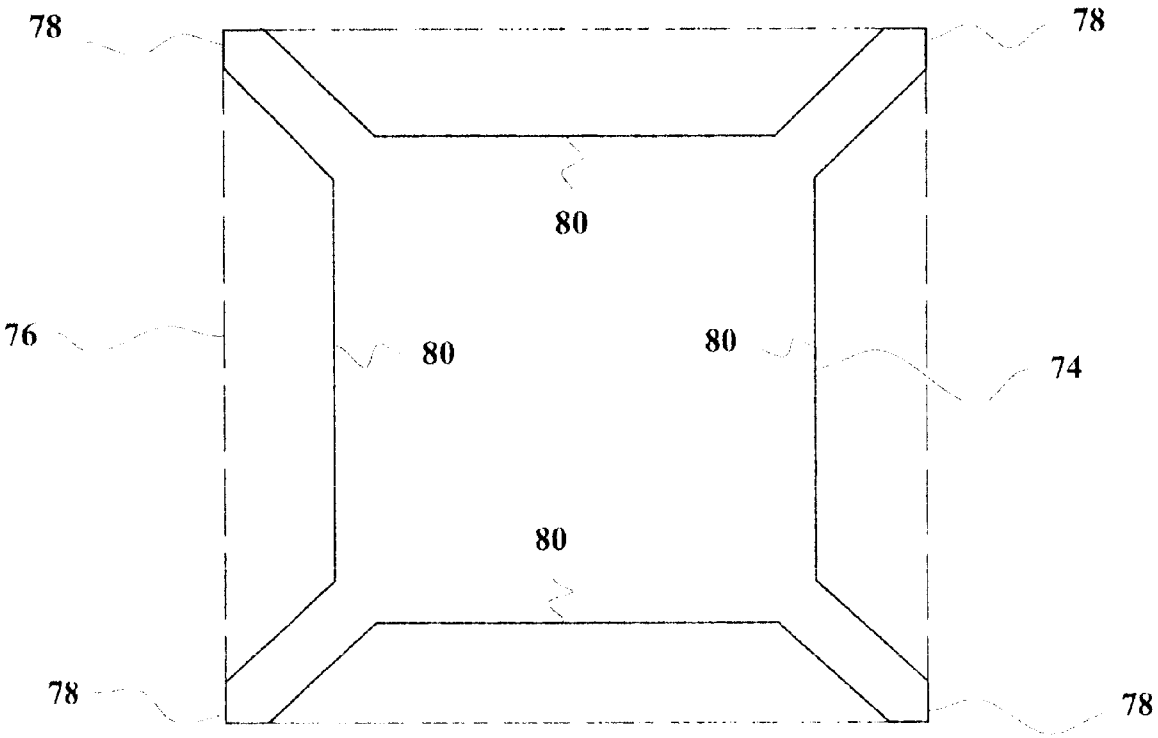
FIG. 13 is a top plan view of the square base plate of the second and third preferred embodiments of the invention.

FIG. 13 is a top plan view of the square base plate 74 of the second and third preferred embodiments of the invention. The base plate is cut from an original square plate 76, shown in broken lines. The plate is preferably steel. A plasma arc welder is the preferred means for cutting the plate, but a hacksaw or any other suitable cutting means may be used. Stubs 78 remain after portions 80 of the original plate are cut away. The stubs preferably extend from corners of the base plate, but alternatively they may extend from sides of the base plate.

Figure 14:
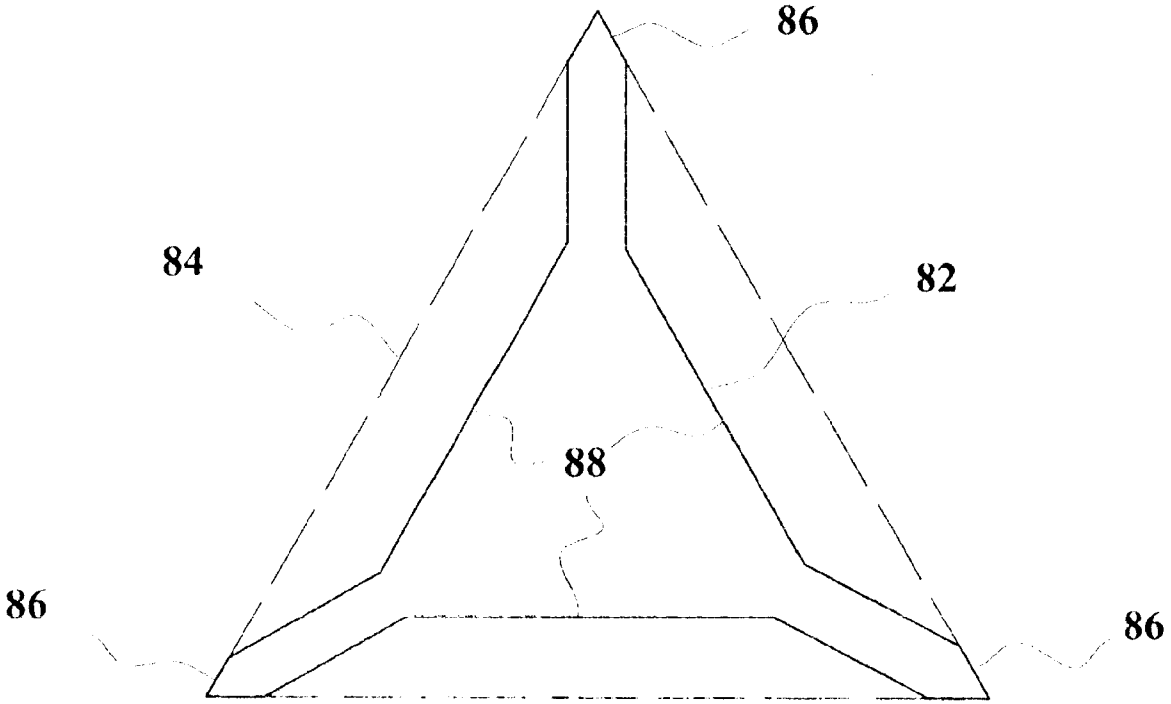
FIG. 14 is a top plan view of the triangular base plate of the second and third preferred embodiments of the invention.
Figure 15:
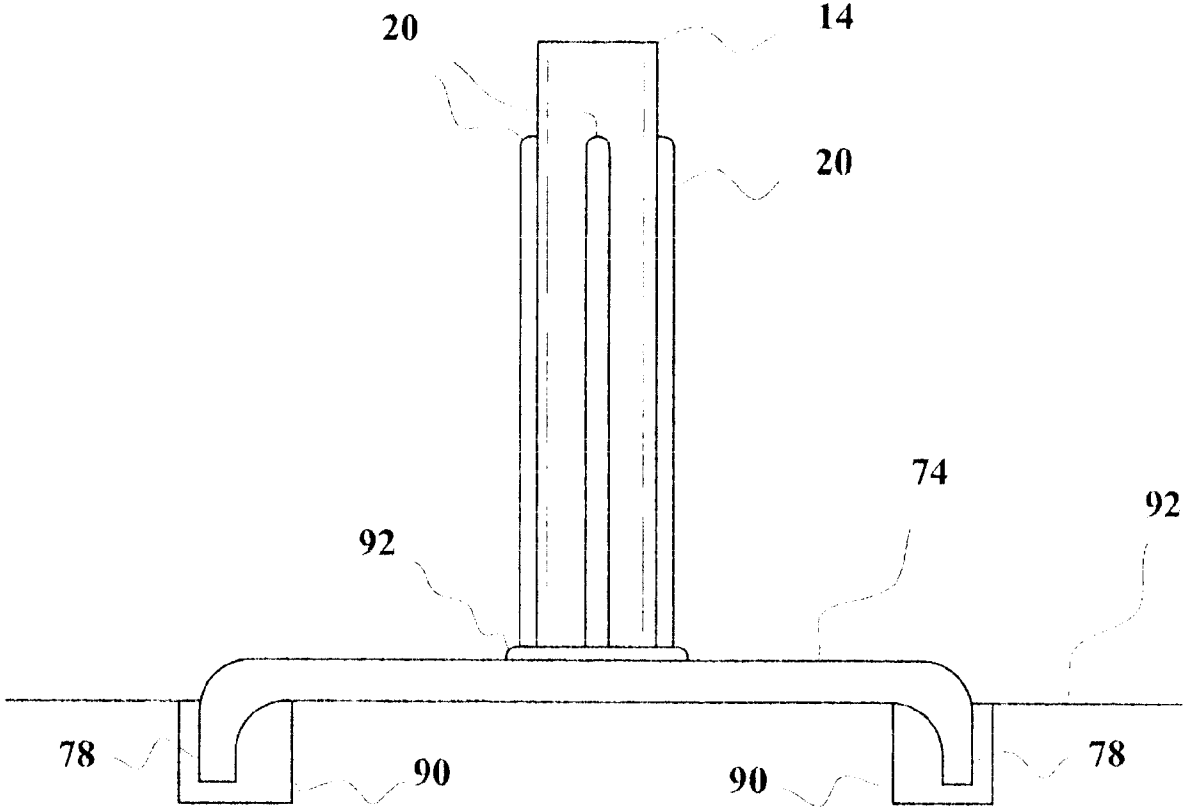
FIG. 15 is a side elevational view of the second preferred embodiment of the invention.

FIG. 14 is a top plan view of the triangular base plate 82 of the second and third preferred embodiments of the invention. The base plate is cut from an original triangular plate 84, shown in broken lines. Stubs 86 remain after portions 88 of the original plate are cut away. The stubs preferably extend from vertices of the base plate, but alternatively they may extend from sides of the base plate. Alternatively, the base plate may be any polygonal, circular, elliptical, or other shape. After the base plate is cut out from the original plate, the portions of the studs near the main body of the base plate are heated with a blow torch, arc welder, or other suitable means, and the studs are bent downwards so that they are at right angles from the main body of the base plate. (The studs may be bent upwards, with the plate being turned over when it cools.) FIG. 15 is a side elevational view of the second preferred embodiment of the invention, showing the metal pipe 14 with strips of hard facing 20 retained on the square base plate 74 by a continuous weld 92. Holes 90 that are suitably dimensioned and configured to receive the studs 78 are drilled (or otherwise formed) in a concrete surface or other hard solid surface 92. Epoxy is placed in the holes, and the studs are then inserted into the holes. When the epoxy hardens, the base plate is thereby retained on the surface.

Figure 16:
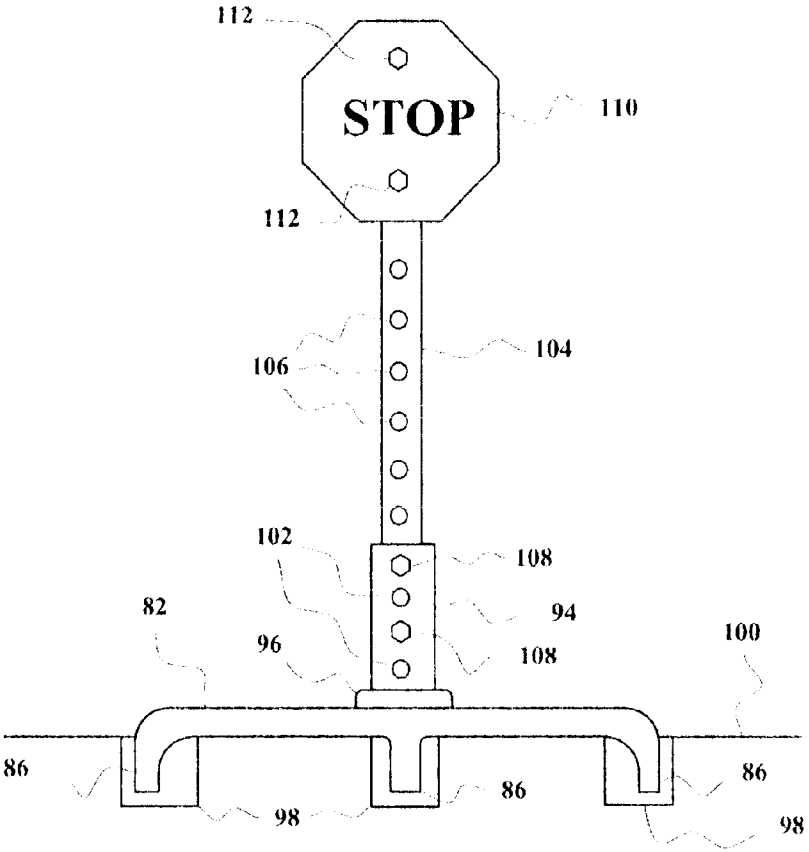
FIG. 16 is a side elevational view of the third preferred embodiment of the invention.

FIG. 16 is a side elevational view of the third preferred embodiment of the invention, showing a sleeve 94 retained on the triangular base plate 82 by a continuous weld 96. Holes 98 that are suitably dimensioned and configured to receive the studs 86 are drilled (or otherwise formed) in a concrete surface or other hard solid surface 100. As before, epoxy is placed in the holes, and the studs are then inserted into the holes, so that the base plate is retained on the surface when the epoxy hardens. The sleeve has transverse holes 102 and is suitably dimensioned and configured to receive an upright member 104. The upright member is preferably a U-shaped channel with transverse holes 106, but may also be a pipe or other elongated vertical object. The upright member may be retained in the sleeve by bolts 108 that pass through the transverse holes. A sign 110 (or other object) may be retained at the top of the upright member by bolts 112.

Figure 17:
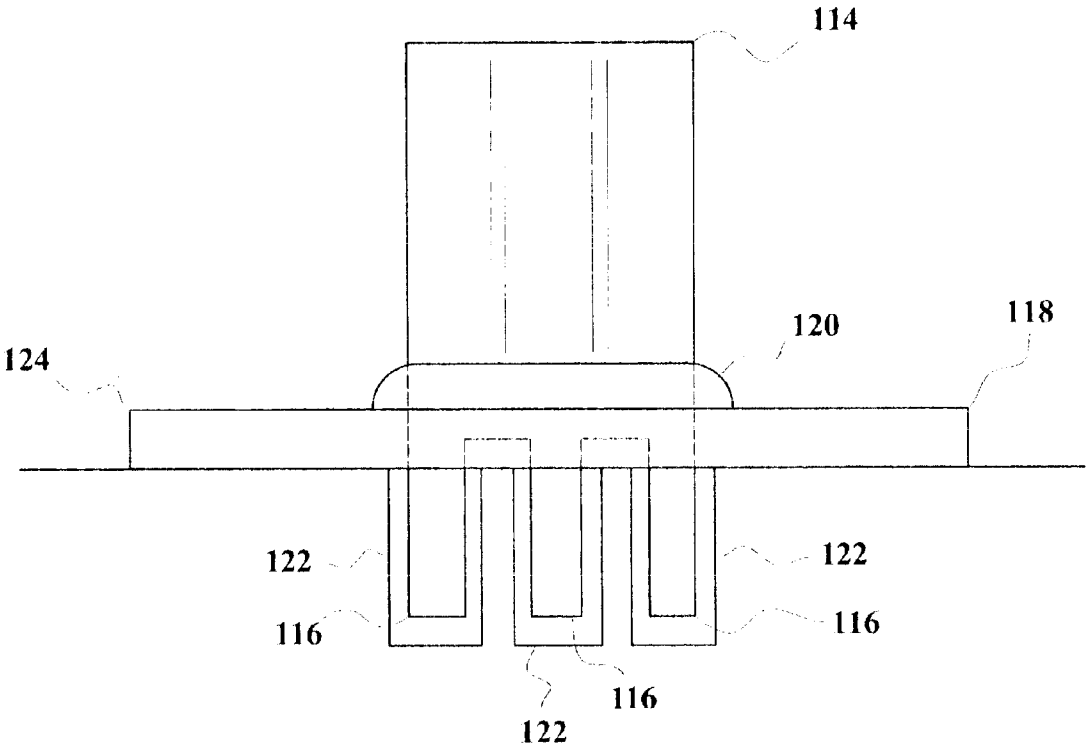
FIG. 17 is a side elevational view of the fourth preferred embodiment of the invention.

FIG. 17 is a side elevational view of the fourth preferred embodiment of the invention. Portions are cut away from the bottom of a U-shaped channel 114 (or other channel or pole), leaving studs 116 that extend downward. The pole or channel is inserted through a hole in the middle of the base plate 118, and joined to the base plate by a continuous weld 120. The studs are inserted into holes 122 in the concrete surface 124 and retained therein by epoxy. The U-shaped channel may have a hollow interior and serve as a sleeve for retaining another U-shaped channel, as shown in FIG. 16.

It is to be understood that the present invention is not limited to the preferred embodiments described above, nor is it limited to parking meters or signs, but also encompasses other objects to which any aspect of the invention could apply, and any and all embodiments within the scope of the following claims.

What is claimed is:

1. A structure for supporting an upright member on a solid surface, comprising:

a concrete surface having a plurality of holes;

a metal base plate having a plurality of projections that are at right angles downward from the base plate, and are retained in the hole by an epoxy; and a metal upright member welded to the base plate at right angles to the base plate.

2. A structure for supporting an upright member on a solid surface according to claim 1, wherein:

the base plate has a polygonal shape; and the projections are at corners of the base plate.

3. A structure for supporting an upright member on a solid surface according to claim 1, wherein:

surfaces of the projections are threaded.

4. A structure for supporting an upright member on a solid surface according to claim 1, wherein:

the upright member is a pole; and a hard-facing has been applied in strips to a surface of the pole, said hard-facing having a hardness greater than that of the pole itself, and said hard-facing containing metallic elements.

5. A structure for supporting an upright member on a solid surface according to claim 1, wherein:

the upright member is hollow; and an elongated member has a lower portion that is retained within the upright member, and an upper portion that extends above the upright member.

6. A structure for supporting an upright member on a solid surface according to claim 5, wherein:

a sign is retained on the upper portion of the elongated member.

7. A structure for supporting an upright member on a solid surface, comprising:

a solid surface having a plurality of holes;

a upright member having an upper end and a lower end with a plurality of projections that are retained in the holes in the solid surface by an adhesive; and a base plate resting on the solid surface and retained on the upright member, said base plate having a central hole through which the upright member passes.

8. A structure for supporting an upright member on a solid surface according to claim 7, wherein:

the solid surface is a concrete surface;

the upright member and the base plate are made of metal; and the base plate is welded to the upright member.

9. A structure for supporting an upright member on a solid surface according to claim 8, wherein:

a sign is retained on the upper end of the upright member.

* * * * *